US005301647A

United States Patent [19]

Lorraine

[11] Patent Number: 5,301,647

[45] Date of Patent: Apr. 12, 1994

[54] FUEL INJECTOR ATTACHMENT CLIP

[75] Inventor: Jack R. Lorraine, Newport News, Va.

[73] Assignee: Siemens Automotive L.P., Auburn Hills, Mich.

[21] Appl. No.: 76,829

[22] Filed: Jun. 14, 1993

[51] Int. Cl.[5] ..... F02M 55/02

[52] U.S. Cl. ..... 123/470; 123/456

[58] Field of Search ..... 123/470, 472, 468, 469, 123/456; 239/600, 585

[56] References Cited

U.S. PATENT DOCUMENTS

| | | | |
|---|---|---|---|
| 4,474,160 | 10/1984 | Gartner | 123/470 |
| 5,005,898 | 4/1991 | Smith | 123/470 |
| 5,035,224 | 7/1991 | Hornby | 123/470 |
| 5,038,738 | 8/1991 | Hafner | 123/456 |
| 5,074,269 | 12/1991 | Herbon | 123/470 |
| 5,136,999 | 8/1992 | Bassler | 123/470 |
| 5,167,213 | 12/1992 | Bassler | 123/456 |
| 5,203,304 | 4/1993 | Hafner | 123/470 |
| 5,209,204 | 5/1993 | Bodenhausen | 123/470 |

FOREIGN PATENT DOCUMENTS 3014066 10/1981 Fed. Rep. of Germany ..... 123/470

*Primary Examiner*—Carl S. Miller

*Attorney, Agent, or Firm*—George L. Boller; Russel C. Wells

[57] ABSTRACT

An attachment clip for connecting a top-feed fuel injector to a socket on a fuel rail has a cylindrical wall that is coaxial with the fuel inlet tube of the injector and contains a pattern of circumferentially spaced apertures. At each aperture there is at least one catch that extends from the margin of a circumferentially extending edge of the aperture radially inwardly and axially toward the fuel injector body to terminate at a distal end that is axially within the axial span of the aperture. The circumferential span of each catch is less than that of the aperture. As the fuel inlet tube is pushed into the socket, the catches are resiliently flexed by engagement with the socket rim until the distal ends of the catches clear a lip extending around the outside of the rim at which point they relax to lodge behind the lip thereby attaching the fuel injector to the socket.

20 Claims, 1 Drawing Sheet

FUEL INJECTOR ATTACHMENT CLIP

FIELD OF THE INVENTION

This invention relates to a clip for attaching one component of a fuel injection system, namely a fuel injector, to another component, namely a fuel rail socket.

BACKGROUND AND SUMMARY OF THE INVENTION

Various forms of clips for fastening different fuel injection system components together have heretofore been proposed. Certain clips are designed to be assembled to one of the components preparatory to assembling that component to the other; for example, certain clips assembled to a fuel injector are designed to allow the fuel injector to be fastened to a fuel rail socket, or cup, by simply pushing the clip-containing fuel injector into the socket. Other forms of fastening a fuel injector to a fuel rail socket embody catches that are integrally formed with a portion of the body of a fuel injector and that snap over a lip on a socket. Examples of the latter appear in U.S. Pat. No. 4,991,557 and U.S. Pat. No. 5,038,738.

The present invention relates to a new and different fastening clip that is well-suited for integral formation with a portion of the body of a fuel injector and that provides convenient attachment and secure retention. Briefly, the disclosed embodiment of clip comprises a cylindrical wall that circumferentially bounds, and is spaced radially outwardly of, the fuel inlet tube and that has several circumferentially spaced apertures at which catches are disposed. Each catch extends from a circumferentially extending edge of the corresponding aperture radially inwardly and axially toward the body of the fuel injector to lodge behind a lip extending around the outside of the socket rim when attachment of the fuel injector to the socket has been completed. The circumferential span of each catch lies within the circumferential span of the aperture at which it is disposed. The catches flex as they pass over the socket lip during insertion of the fuel injector inlet tube into the socket. Once they have cleared the lip, the catches relax, lodging behind the lip to provide an interference therewith that prevents removal of the fuel injector from the socket. The catches are somewhat in the nature of deflectable barbs that allow relatively easy insertion of the fuel injector into the socket, but that strenuously resist removal of the fuel injector from the socket once they have passed the socket lip.

Details of the invention are disclosed in the following Description of a Preferred Embodiment which is accompanied by drawings. The drawings illustrate a presently preferred embodiment of the invention according to the best mode contemplated at this time for carrying out the invention.

DESCRIPTION OF A PREFERRED EMBODIMENT

Figure 1:
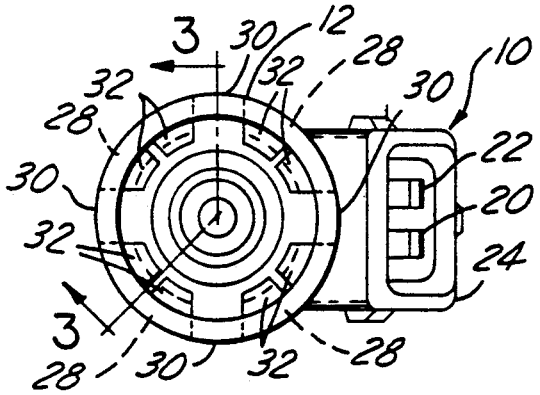
FIG. 1 is a top plan view of a fuel injector having an attaching clip embodying principles of the invention.

The drawings show a fuel injector 10 that is a conventional top-feed type except for a novel attaching clip 12 at the fuel inlet end 14 which is opposite the nozzle end 16. The fuel inlet end comprises a fuel inlet tube 18 that is coaxial with attaching clip 12. Pressurized liquid fuel is introduced into the fuel injector through inlet tube 18. Internally, the fuel injector comprises an electrically operated valve that is remotely controlled to cause periodic injections of fuel from nozzle end 16. The electrical operation of the fuel injector is via electric terminals 20, 22 that are part of an electrical connector 24 on the exterior of the fuel injector body.

Attaching clip 12 is formed integrally with a portion of the body of the fuel injector and comprises a circular cylindrical wall 26 that extends axially away from the body coaxial with, and spaced radially outwardly of, inlet tube 18. Wall 26 contains four identical apertures 28 that extend radially through wall 26 and that are arranged in a uniform pattern. Each aperture 28 has both an axial and a circumferential extent with two circumferentially extending edges mutually parallel and two axially extending edges mutually parallel. The apertures are circumferentially side-by-side and separated by bars 30 in wall 26.

At each aperture 28 there are two identical catches 32 that are circumferentially side-by-side. These catches are integrally formed with wall 26 extending from the margin of the circumferentially extending edge of the aperture that is farther from the injector body. Each catch has a certain circumferential extent; it also has a radial-axial extent. The radial-axial extent of each catch extends from a proximal portion on wall 26 to a distal portion that is spaced axially toward the fuel injector body and radially inwardly of the proximal portion. The circumferential extent, or span, of the two catches at each aperture is less than the circumferential extent, or span, or the corresponding aperture 28, and necessarily the circumferential extent of each individual catch is also less than the circumferential extent of the corresponding aperture. The distal portions of the catches are disposed substantially on an imaginary circle that is concentric with, but of larger diameter than, inlet tube 18. As will become more apparent from ensuing description, the catches flex as the fuel injector is being attached to a fuel rail cup, expanding the diameter of this imaginary circle in the process, until full attachment is attained at which time the catches relax, contracting the diameter of the imaginary circle in the process. The distal portion of each catch does not extend axially toward the injector body farther than the circumferentially extending edge of its aperture that is nearer the injector body.

Figure 2:
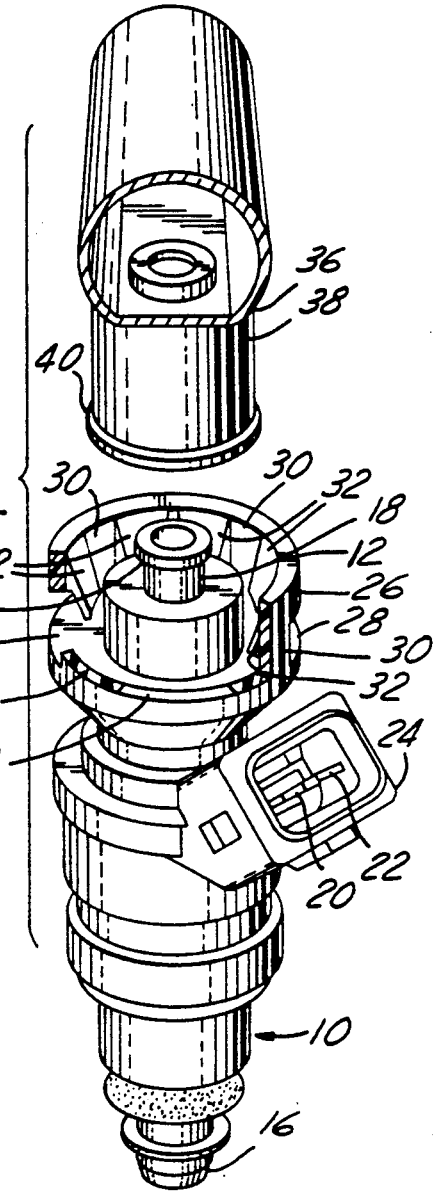
FIG. 2 is an exploded perspective view, having portions sectioned away for illustrative purposes, of the fuel injector of FIG. 1 and of a fuel rail and socket with which the fuel injector is adapted to be associated.
Figure 3:
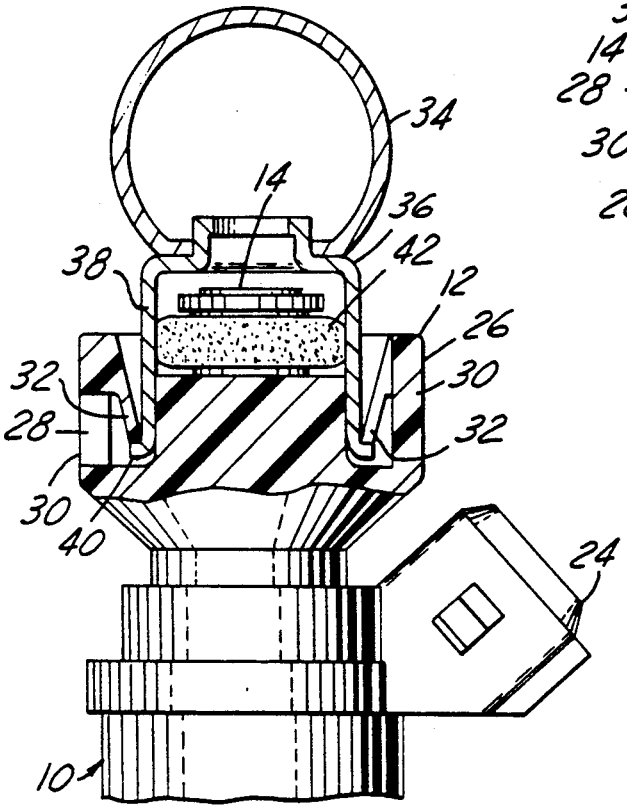
FIG. 3 is an enlarged cross sectional view in the direction of arrows 3—3 in FIG. 1 of the inlet end of the fuel injector.
Figure 4:
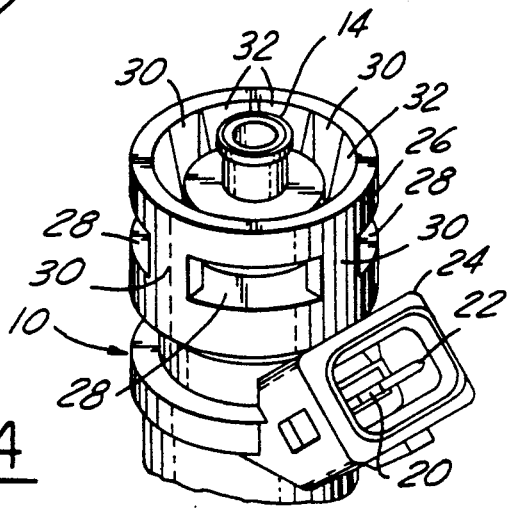
FIG. 4 is a fragmentary perspective view of the inlet end of the fuel injector, as viewed in FIG. 2, but without a portion thereof being sectioned away.

FIGS. 2 and 3 show a representative fuel rail 34 having a socket, or cup, 36 with which inlet end 14 of fuel injector 10 is associated. Socket 36 comprises a circular cylindrical sidewall 38 having a radially outwardly directed lip 40 at its free end. An O-ring seal 42 on inlet end 14 seals the fuel injector to the socket when the inlet end is inserted into the socket. Liquid fuel passes from the fuel rail via the socket to enter the fuel inlet tube of the fuel injector. FIG. 3 shows fuel injector 10 attached to socket 36 by means of attaching clip 12. The distal portions of catches 32 are shown in FIG. 3 lodged behind lip 40 keeping the fuel injector attached to the socket.

FIG. 2 portrays the manner of assembling the fuel injector to the fuel rail. With the inlet end 14 substantially co-aligned with socket 36, the fuel injector is advanced toward the socket, inserting the inlet tube and seal into the socket in the process. As this is happening, the catches 32 encounter lip 40 and are increasingly spread open. Each catch may be considered to be more or less cantilever-mounted on wall 26 so that it flexes in a more or less cantilever fashion. When the distal ends of the catches have cleared the lip, the catches relax to assume the position of FIG. 2 where they are in interference with the lip so as to keep the fuel injector attached.

If it is desired to detach the fuel injector from the socket, a tool designed to fit inside wall 26 at its open axial end and spread the catches open may be used to release them from behind lip 40 allowing the fuel injector to be pulled out of the socket.

The illustrated attachment clip is designed to be fabricated integrally with a portion of the injector body that is made by injection molding. A mold for making the attachment clip can comprise two moveable mold parts that open and close along a diameter through the axis of the attachment clip.

While a presently preferred embodiment of the invention has been illustrated and described, it should be appreciated that principles are applicable to other embodiments falling within the scope of the following claims.

What is claimed is:

1. A fuel injector for injecting fuel into an engine for entrainment with air to form a combustible mixture that is combusted internally of the engine, said fuel injector comprising a body having a nozzle at one end via which fuel is injected from the fuel injector and an inlet at another end via which the fuel injector receives fuel, an attaching clip disposed on said body in circumferentially bounding relationship to said inlet for attaching the fuel injector to a socket which has a radially outwardly directed lip and is adapted to receive said inlet in a sealed manner for introducing fuel into the fuel injector, said attaching clip comprising a cylindrical wall extending axially from said body, said cylindrical wall comprising one or more apertures each extending radially through said wall and having a limited circumferential span, and at each such aperture, a catch that has a proximal portion on said wall and that extends from a circumferentially extending edge portion of the corresponding aperture radially inwardly and axially toward said body to terminate at a distal portion that is spaced radially inwardly and axially toward said body from said proximal portion for lodging behind the socket lip when the fuel injector is clipped to the socket by said attaching clip, and each said catch having a circumferential span that lies within the circumferential span of the corresponding aperture.

2. A fuel injector as set forth in claim 1 in which said connector clip comprises plural such apertures and catches circumferentially spaced around said wall.

3. A fuel injector as set forth in claim 2 in which each of said catches is cantilever-mounted on said wall along a corresponding circumferentially extending margin of said circumferentially extending edge portion of the corresponding aperture, and each said catch has its proximal portion within the axial span of the corresponding aperture.

4. A fuel injector as set forth in claim 3 in which said apertures are substantially identical and arranged in a uniform pattern circumferentially around said wall.

5. A fuel injector as set forth in claim 4 in which said wall and catches are integrally formed with a portion of said body.

6. A fuel injector as set forth in claim 5 in which at each said aperture there are plural such catches disposed circumferentially side-by-side.

7. A fuel injector as set forth in claim 2 in which said wall and catches are integrally formed with a portion of said body.

8. A fuel injector as set forth in claim 7 in which said apertures are substantially identical and arranged in a uniform pattern circumferentially around said wall.

9. A fuel injector as set forth in claim 8 in which at each said aperture there are plural such catches disposed circumferentially side-by-side.

10. A fuel injector as set forth in claim 2 in which at each said aperture there are plural such catches disposed circumferentially side-by-side.

11. A fuel injection system comprising first and second components that are fluid-coupled in a sealed manner to form a joint for the conveyance of fuel from one component to the other component, said components comprising respective cylindrical walled tubes have mutually telescopically engaged ends forming said joint, one tube inside the other, said other tube comprising a radially outwardly directed lip, an attaching clip having a mounting on said one tube beyond the mutually telescopically engaged ends of said tubes and comprising a cylindrical wall extending axially from said mounting, said cylindrical wall comprising one or more apertures each extending radially through said wall and having a limited circumferential span, and at each such aperture, a catch that has a proximal portion on said wall and that extends from a circumferentially extending edge portion of the corresponding aperture radially inwardly and axially toward said mounting to terminate at a distal portion that is spaced radially inwardly and axially toward said mounting from said proximal portion to lodge behind said lip, and each said catch having a circumferential span that lies within the circumferential span of the corresponding aperture.

12. A fuel injection system as set forth in claim 11 in which said one component is a socket of a fuel rail and said other component is a fuel injector.

13. A fuel injection system as set forth in claim 11 in which said connector clip comprises plural such apertures and catches circumferentially spaced around said wall.

14. A fuel injection system as set forth in claim 13 in which said catches are cantilever-mounted on said wall along a corresponding circumferentially extending margin of said circumferentially extending edge portion of the corresponding aperture at a circumferentially extending edge of the corresponding aperture.

15. A fuel injection system as set forth in claim 14 in which said apertures are substantially identical and arranged in a uniform pattern circumferentially around said wall.

16. A fuel injection system as set forth in claim 15 in which at each said aperture there are plural such catches disposed circumferentially side-by-side.

17. A fuel injection system as set forth in claim 13 in which said apertures are substantially identical and arranged in a uniform pattern circumferentially around said wall.

18. A fuel injection system as set forth in claim 17 in which at each said aperture there are plural such catches disposed circumferentially side-by-side.

19. A fuel injection system as set forth in claim 13 in which at each said aperture there are plural such catches disposed circumferentially side-by-side.

20. A fuel injection system as set forth in claim 11 each said catch having its proximal portion within the axial span of the corresponding aperture.

* * * * *